US005578429A

United States Patent [19]

Fyson

[11] Patent Number: 5,578,429

[45] Date of Patent: Nov. 26, 1996

[54] METHOD OF PROCESSING PHOTOGRAPHIC SILVER HALIDE MATERIALS

[75] Inventor: John R. Fyson, Hackney, United Kingdom

[73] Assignee: Eastman Kodak Company, Rochester, N.Y.

[21] Appl. No.: 436,509

[22] Filed: May 8, 1995

[30] Foreign Application Priority Data

Jul. 30, 1994 [GB] United Kingdom ..... 9415430

[51] Int. Cl.[6] ..... G03C 5/29; G03D 3/00

[52] U.S. Cl. ..... 430/401; 430/398; 430/399; 430/400; 430/494; 430/30; 396/568; 396/626; 396/633

[58] Field of Search ..... 430/398, 403, 430/30, 399, 400, 401, 494; 354/410, 299, 328, 329, 330

[56] References Cited

U.S. PATENT DOCUMENTS 4,240,737 12/1980 Lawson ..... 354/299

FOREIGN PATENT DOCUMENTS

93/11463 6/1993 WIPO .

OTHER PUBLICATIONS

James, T. H., "The Theory of the Photographic Process", 4th ed. p. 411, New York, 1977.

*Primary Examiner*—Mark F. Huff
*Attorney, Agent, or Firm*—J. Lanny Tucker

[57] ABSTRACT

A method of imagewise exposing and processing a photographic silver halide color material in a machine containing a number of non-replenished processing tanks or processing tanks that are supplied from a non-replenished source, the method comprising increasing the exposure time automatically by a predetermined factor related to the area of photographic material already processed and the volume of the non-replenished processing solution.

5 Claims, 3 Drawing Sheets

METHOD OF PROCESSING PHOTOGRAPHIC SILVER HALIDE MATERIALS

FIELD OF THE INVENTION

The invention relates to a method of processing a photographic silver halide material that enables non-replenished processing baths to provide images of non-varying quality.

BACKGROUND OF THE INVENTION

In the field of photographic processing it is well known to replenish processing solutions to compensate for loss of developer components by consumption by the process and aerial oxidation. Such a replenishment system requires replenisher pump(s), pipework and control means, all of which adds to the cost of the machine.

Some processing machines can be supplied by premixed solutions that are usually run until they produce unacceptable results. At this point the solutions are discarded and are never replenished. This clearly avoids the replenishment system described above.

The problem experienced with such non-replenished machines is that the quality of the images produced will deteriorate with continued use of the same solution. This means that the processing solutions must be discarded at a comparatively early stage if unvarying high quality processing is desired.

SUMMARY OF THE INVENTION

According to the present invention there is provided a method of imagewise exposing and processing a photographic silver halide color material in a machine containing a number of non-replenished processing tanks or processing tanks that are supplied from a non-replenished source, The method comprising increasing the exposure time automatically by a predetermined factor related to the area of photographic material already processed and the volume of the non-replenished processing solution.

The materials processed employing the present method have substantially unvarying sensitometric quality over a longer time period than when uniform exposure has been given to each image.

BRIEF DESCRIPTION OF THE DRAWINGS

In the accompanying drawings FIG. 1 is a schematic diagram of processing apparatus that may be used while

DETAILED DESCRIPTION OF THE INVENTION

The present method applies to situations where the exposure time is under the control of the processor rather than the original photographer. For example, this would include the making of color prints or duplicate slides or prints.

In a preferred embodiment the non-replenished processing solution is a color developer solution.

A typical printer machine gives red, green and blue exposures automatically adjusted according to its determination of a number of parameters. The control of the exposure required by the present invention may be different for each color exposure.

The present invention is particularly applicable to processing machines that accept a solution supply unit in which there are separate compartments holding the various solutions needed. Preferably one or more of the processing solutions are circulated between the a solution supply unit and the processing tank continuously or intermittently.

In one embodiment of the present invention the processing machine is controlled by a microprocessor that receives data from the processing machine as to the area of photographic material processed. In response to this data the exposure time in one or more color exposures is increased by a predetermined factor.

In order to find out what the predetermined factor should be, measurements are taken during a processing run of photographic material exposed to a color step wedge that has been processed without any exposure adjustment. The speed of each image can then be determined in the usual way. This will then give an indication of the factor by which the exposure should be increased to compensate for apparent loss of "speed" due to solution deterioration.

Typically the increase in exposure per print will depend on the size of the print and the volume of processing solution being used. The increase gets bigger with less solution and with larger sheets. In one embodiment the increase in exposure is by a factor in the range 1.0005 to 1.005, preferably in the range 1.002 to 1.004 per A4-sized print in 500 ml processing solution. There may be variations in these rates for each color exposure.

The preferred processing solution whose volume is taken into account is the color developer solution.

It is, of course, the developer solution that is particularly critical in color processing but it is not the only solution to which the present method can be applied.

Figure 1:
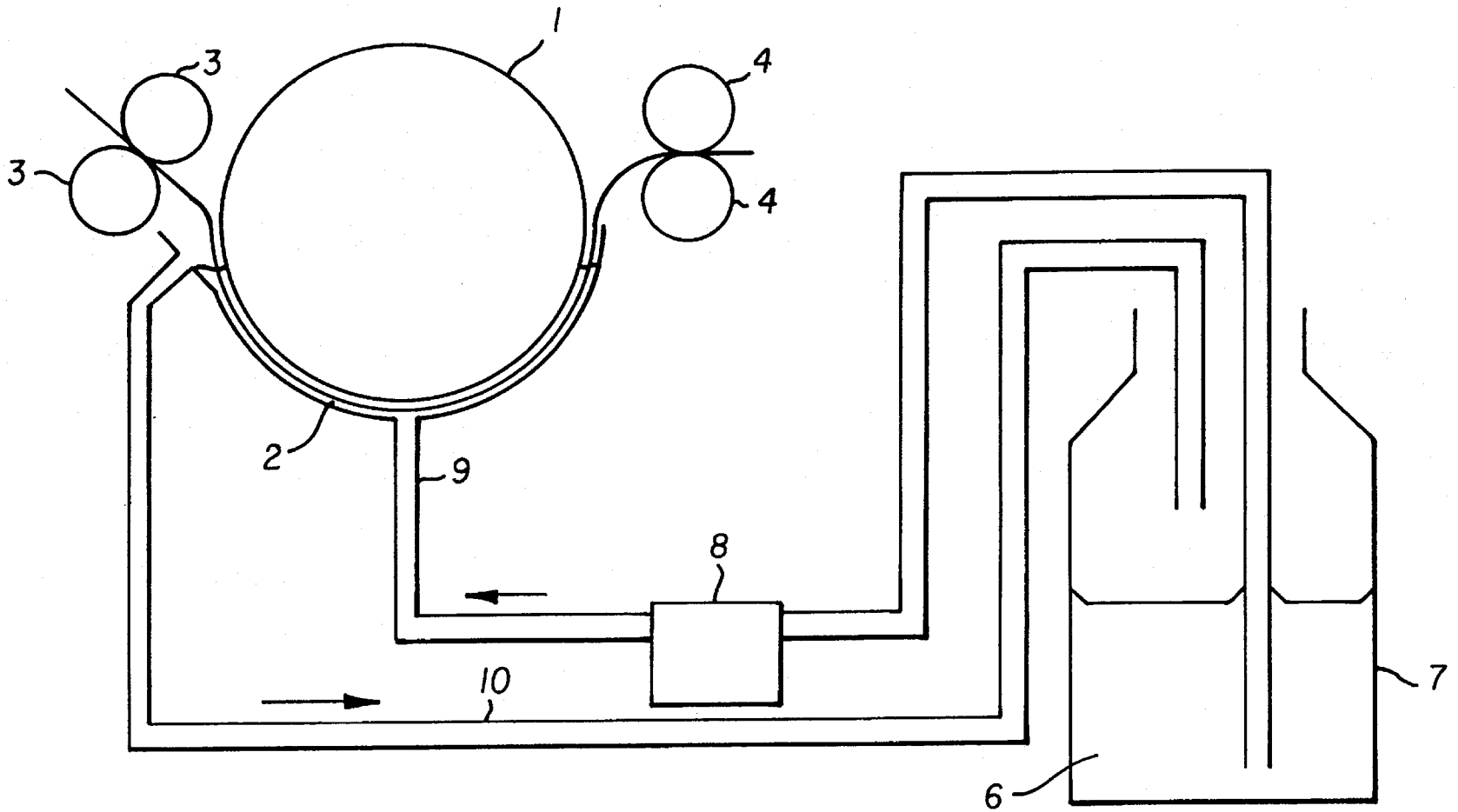

In FIG. 1 of the accompanying drawings the processing machine comprises a rapidly rotating processor drum (1) which rotates in a tank of small volume (2) having input transport rollers (3) and output transport rollers (4) through which the sheet of photographic material is driven. The processing machine will also comprise other processing tanks (not shown) as is well understood. The processing solution (6) for tank (2) is held in reservoir (7) and is circulated by pump (8) through pipes (9) and (10).

The preferred type of photographic material to be processed by the present method is negative color paper. A particular application of this technology is in the processing of silver chloride color paper, for example paper comprising at least 85 mole percent silver chloride.

Typically the photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido-)ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Photographic processing methods are described in Section XIX of Research Disclosure.

The following Examples are included for a better understanding of the invention.

EXAMPLE 1

All processing was carried out in a processing machine, in which the paper experiences high agitation by contacting a rotating drum, similar to one made of several units described in PCT publication no. WO 93/11463.

Processing solutions were pumped continuously through the processor tanks by a peristaltic pump pumping 25 ml/min. One tank's recirculation system is shown in FIG. 1.

Kodak 'Supra' color paper, surface F, sheets of size A4 were used for testing the sensitometry every ten or so processed sheets. This was exposed to a neutral 0.15 log exposure wedge. The process was seasoned by processing a fully exposed A4 sheet of the same paper followed by three unexposed sheets, then another fully exposed sheet followed by three unexposed ones and so on. This approximated 25% maximum exposure that is considered to be about equivalent to average printed density of normal prints. The wedge exposed strips were counted as unexposed strips.

The process sequence was:

| Process | Time (seconds) | Temp. | Total tank + circulation volume |
|---|---|---|---|
| Develop | 30 | 40° C. | 500 ml |
| Bleach-fix | 30 | 22° C. | 500 ml |
| Stabilize | 15 | 22° C. | 500 ml |
| Stabilize | 15 | 22° C. | 500 ml |
| Stabilize | 15 | 22° C. | 500 ml |

The starting developer was one with the following formula (this is similar to RA4 replenisher):

| | |
|---|---|
| Triethanolamine | 11.0 ml |
| Diethylhydroxylamine | 6.0 ml |
| CD3* | 7.3 g |
| PHORWITE ™ REU | 3.0 g |
| Disodium EDTA | 3.0 g |
| Catechol disulphonic acid | 3.0 g |
| Potassium chloride | 0.0 g |
| Potassium carbonate | 25.0 g |
| Water to | 1 liter |
| pH adjusted to 10.4 | |

*CD3 is 4-N-ethyl-N-(b-methanesulphonamidoethyl)-o-toluidine sesquisulphate.

The starting formula of the bleach-fix was as follows (this is similar to RA4 bleach-fix NR)

| | |
|---|---|
| 1.56M Ammonium iron(III) EDTA | 275 ml |
| Ammonium thiosulphate | 225 g |
| Sodium sulphite | 42 g |
| Water to | 1 liter |
| pH adjusted to 5.5 | |

The three wash tanks in the processor were filled with fresh RA4 stabilizer.

Figure 2:
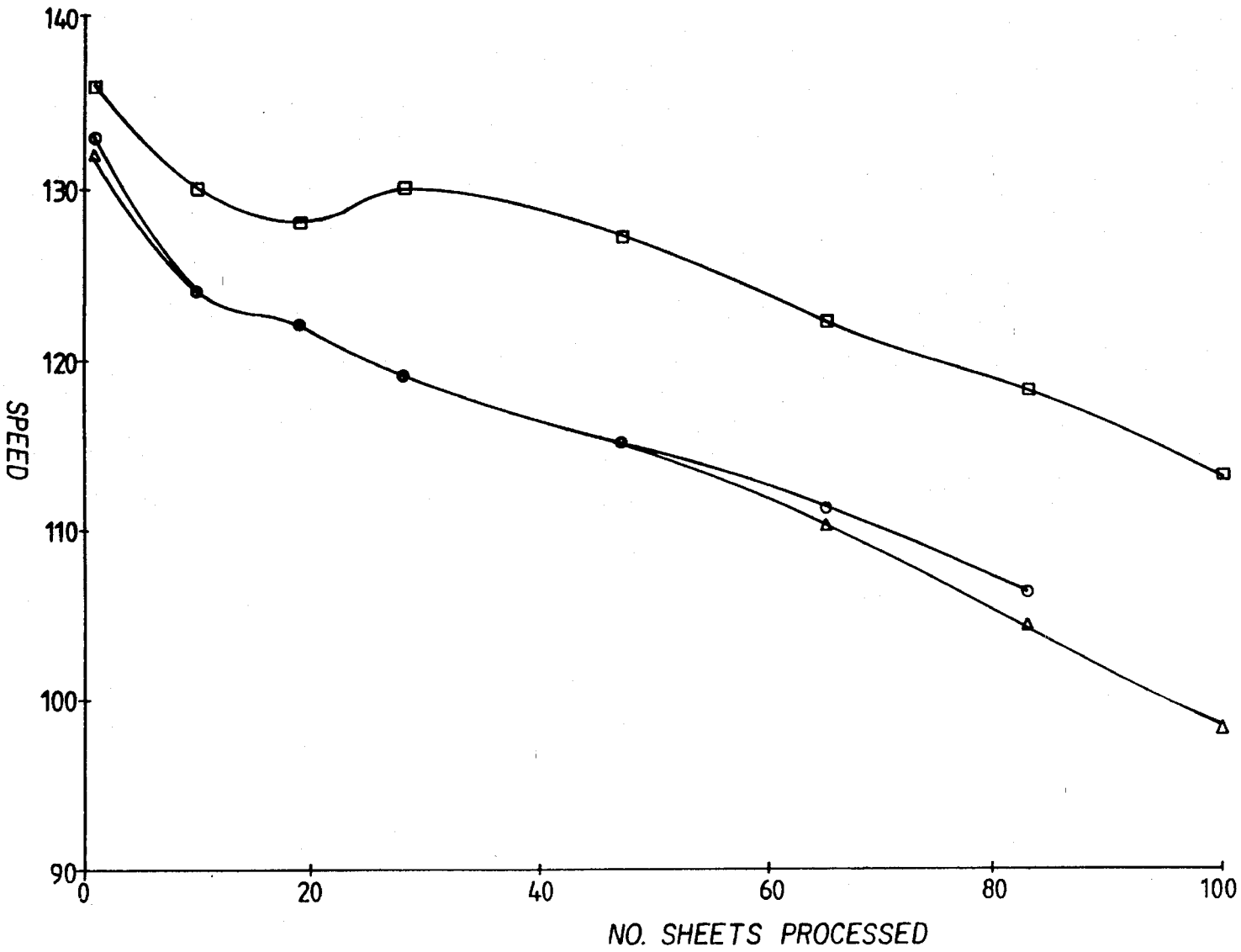
FIGS. 2 and 3 represent the results of the Examples.
Figure 3:
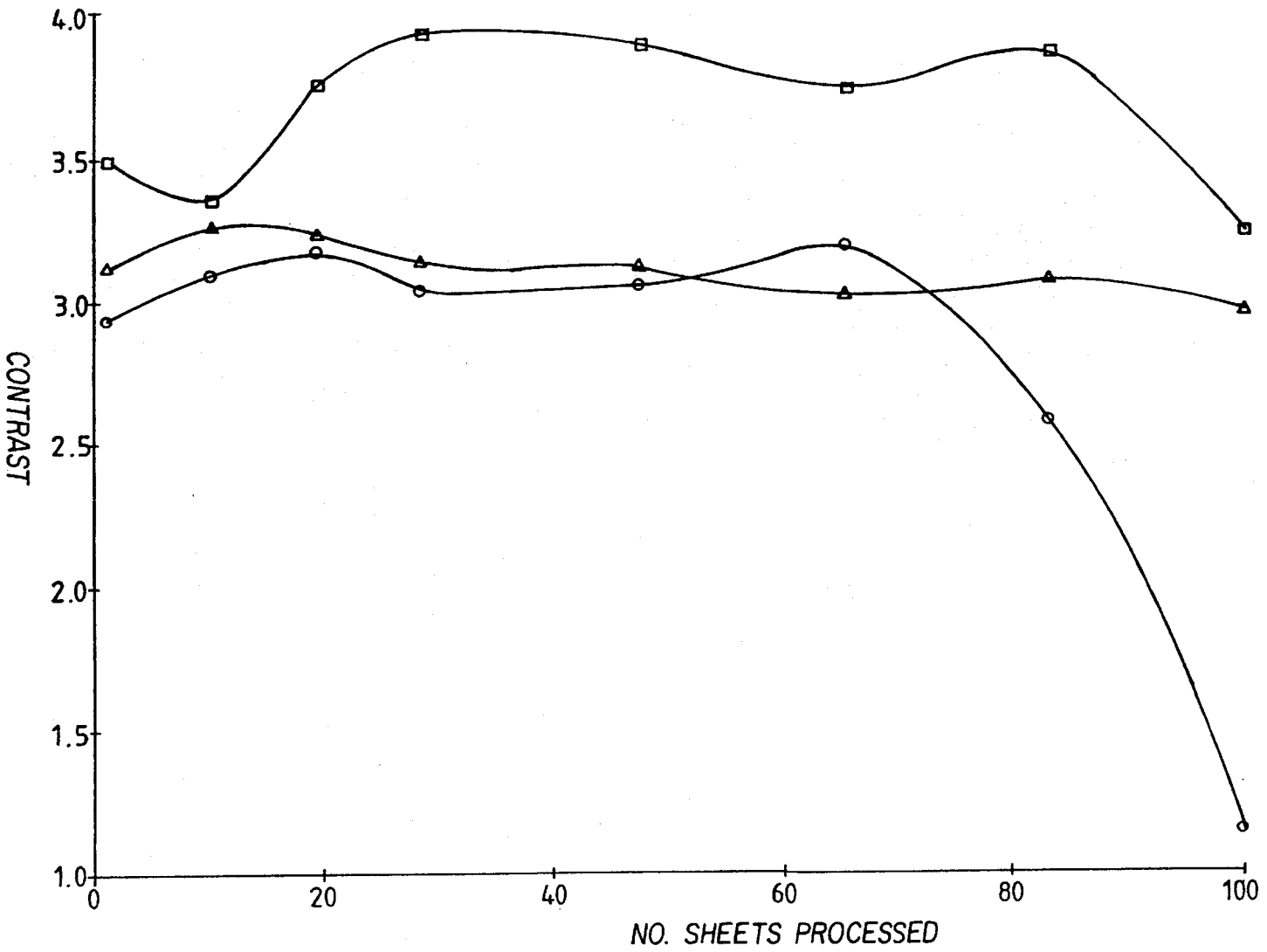

After the equivalent of 100 sheets of paper had been processed along with the exposed wedges, the sensitometry of the exposed wedges was determined and the speeds and contrasts calculated. FIGS. 2 and 3 show the change in speed and contrast of the paper with seasoning respectively. The contrast of all layers stayed more or less constant for the first 60 sheets of paper. This is probably the practical limit of this process/paper combination with no replenishment. The speed of paper decreased more or less linearly with seasoning. The fractional speed change per sheet was 0.0035 for the green and blue sensitive layers and 0.0022 for the red.

EXAMPLE 2

Example 1 was repeated except that instead of processing a wedge every 10 or so sheets, a picture was processed. This picture was exposed on a digitally controlled enlarger. The exposure to give a good print was determined for an unseasoned process. During the test run, the exposure of the print was adjusted to allow for the seasoning. Using the data from Example 1, it was calculated that the exposure time had to be increased by a factor of 1.0035 for green and blue exposures, and 1.0022 for the red exposure.

The processed pictures were collected together and viewed by eye. The resulting prints were virtually indistinguishable from each other.

The invention has been described in detail with particular reference to preferred embodiments thereof, but it will be understood that variations and modifications can be effected within the spirit and scope of the invention.

I claim:

1. In a method of imagewise exposing and thereafter processing a photographic silver halide color material having a silver halide emulsion comprising at least 85 mol % silver chloride, in a machine containing a number of either non-replenished processing tanks or processing tanks that are supplied from a non-replenished source, the method comprising increasing the imagewise exposure time of said material automatically by a factor directly related to the area of photographic material already processed, and inversely related to the volume of a processing solution in one of said processing tanks, said processing solution being contained in a replaceable solution supply unit comprising separate holder compartments for each processing solution, and wherein said processing solution is circulated between said solution supply unit and one of said processing tanks continuously or intermittently.

2. The method of claim 1 wherein said processing solution is a color developing solution.

3. The method of claim 1 in which said factor is in the range of from 1.0005 to 1.005 per A4-sized print in 500 ml color developer.

4. The method of claim 3 wherein said factor is in the range of from 1.002 to 1.004 per A4-sized print in 500 ml color developer.

5. The method of claim 1 in which the photographic material is a negative color paper.

* * * * *